United States Patent [19]

Kuypers

[11] 4,086,031

[45] Apr. 25, 1978

[54] VAPOR DIFFUSION PUMP

[75] Inventor: Ned R. Kuypers, Los Altos, Calif.

[73] Assignee: Hewlett-Packard Company, Palo Alto, Calif.

[21] Appl. No.: 747,744

[22] Filed: Dec. 6, 1976

Related U.S. Application Data

[63] Continuation of Ser. No. 599,276, Jul. 25, 1975, abandoned.

[51] Int. Cl.[2] ..... F04C 19/00

[52] U.S. Cl. ..... 417/154

[58] Field of Search ..... 417/152, 153, 154

[56] References Cited

FOREIGN PATENT DOCUMENTS

| | | | |
|---|---|---|---|
| 850,172 | 9/1960 | United Kingdom | 417/154 |
| 850,658 | 10/1960 | United Kingdom | 417/154 |

*Primary Examiner*—William L. Freeh
*Assistant Examiner*—Edward Look
*Attorney, Agent, or Firm*—Ronald E. Grubman

[57] ABSTRACT

A diffusion pump is provided in which an internal vacuum chamber is surrounded by regions of the pump through which working vapors flow. This configuration enables a single heating unit to heat both the working fluid of the pump and the vacuum chamber.

In certain embodiments, a differential pump is provided in which a common boiler provides working fluid for a pair of pumping sections, each of which evacuates a different vacuum chamber. Application of this pump to a gas chromatograph/mass spectrometer system permits operation with relatively large gas throughput while maintaining a relatively low pressure chamber for the mass spectrometer ion source and a much lower pressure chamber for the mass analyzer.

23 Claims, 2 Drawing Figures

VAPOR DIFFUSION PUMP

CROSS-REFERENCE TO RELATED APPLICATION

This is a continuation of application Ser. No. 599,276 filed July 25, 1975 now abandoned.

BACKGROUND AND SUMMARY OF THE INVENTION

For many purposes it is required to provide a temperature-controlled, high-vacuum environment. Heretofore it has typically been the practice to achieve a high vacuum by interconnecting a diffusion pump to a port of a chamber in which the vacuum is to be established. Temperature control is effected by including a heater and thermal insulation system to mantain the vacuum chamber at a desired operational temperature. In these prior art systems, a separate heating system is employed to heat the working fluid in the diffusion pump to its operating temperature. If, as is typically required, an extremely low contamination atmosphere is to be maintained in the chamber, the diffusion pump must be separated from the vacuum chamber by a cooled trap or vapor baffle arrangement. Thus, conventional systems having duplicate high temperature zones separated by a relatively low temperature zone and composed of separate elements tend to be bulky and expensive to fabricate and operate.

In accordance with the illustrated preferred embodiments, the present invention provides a diffusion pump, including an internal high-vacuum chamber which is surrounded by the working vapor sections of the pump. An instrument requiring a high-vacuum environment may be inserted into the internal chamber. Gas molecules to be evacuated from within the vacuum chamber drift into the vapor pumping region of the pump where they are swept out of the pump by the high velocity working vapor molecules.

In preferred embodiments of the invention, both the working fluid of the diffusion pump and the vacuum chamber itself may be heated by a single heating unit. The heated regions are generally surrounded by a relatively low temperature zone required for working vapor condensation, thus eliminating the need for thermal insulation. To prevent potentially contaminating working vapors from entering the high vacuum chamber, a simple cold cap and cooled baffle may be included.

In accordance with further embodiments, a differential pump is provided in which a common boiler provides working vapor for a pair of pumping units configured so that one of the pair evacuates a first chamber, while the other evacuates a second chamber. These two chambers may be connected by an aperture. Thus, if the device is utilized in conjunction with an analytical instrument such as a gas chromatograph-mass spectrometer (GC/MS) instrument, the first chamber may house the MS ion source and be connected directly to the effluent of the GC while the second chamber houses the MS analyzer. This permits the MS to accept a large fraction of the effluent, or all of the effluent, as desired, from the GC; the first pump need only establish a reasonably low pressure required for the ion source, and can therefore handle a large incoming flux, while the second pump can establish a much lower pressure required by the mass analyzer, since only a small flux enters the second chamber through the aperture from the first chamber. Differential pumping is thereby simply obtained.

DESCRIPTION OF THE PREFERRED EMBODIMENTS

Figure 1:
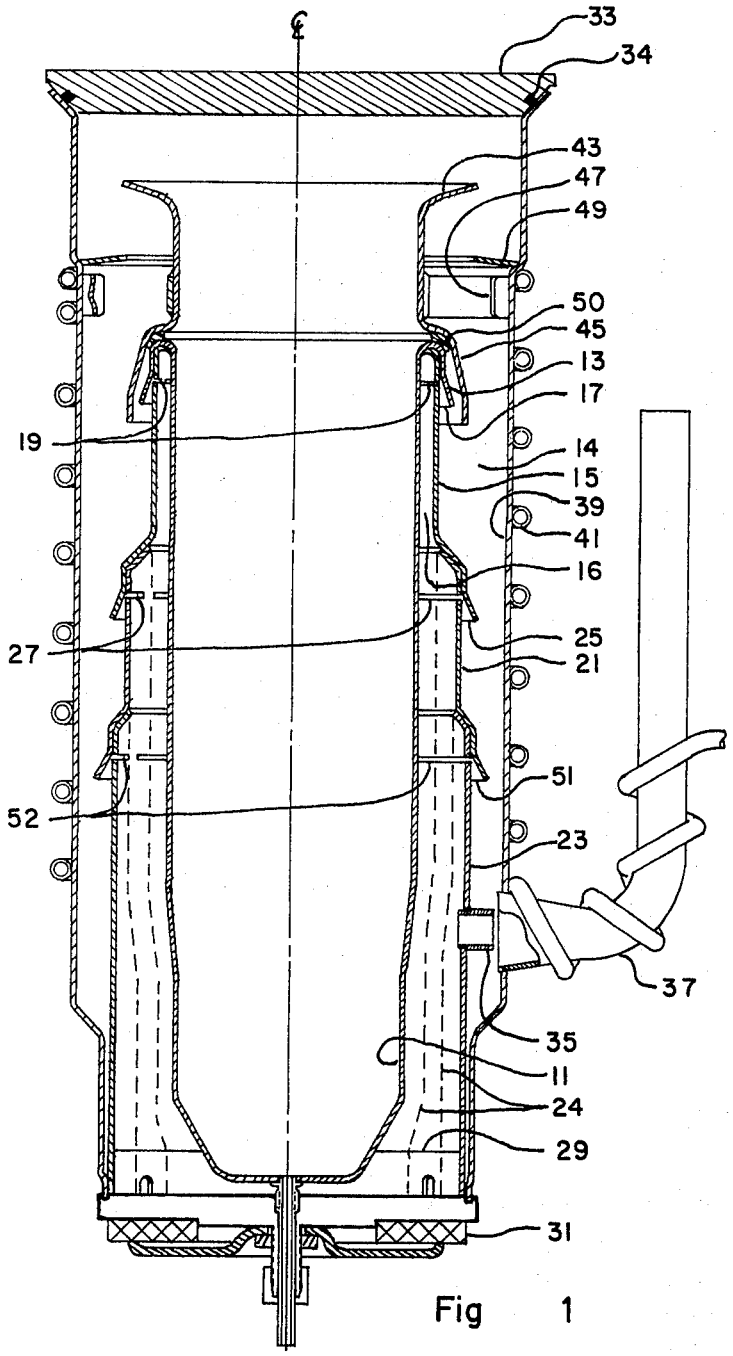
FIG. 1 illustrates a preferred embodiment of a diffusion pump.

In FIG. 1 there is shown a vacuum chamber 11, which, for purposes of illustration, is shown as being generally a cup-like cylindrical shape. Chamber 11, and other pump elements whose description follow, may be fabricated, e.g., from mild steel or stainless steel, or other suitable materials which will be apparent to those skilled in the art. The chamber includes an upper flange or lip portion 13. An annular element 15 is fitted concentrically around chamber 11 so that the top-most portion of annular element 15 fits within flange 13, thereby creating a divergent nozzle element 17. The region between annular section 15 and the outer wall of chamber 11 will be referred to as the "working vapor region 16," and extends generally downward around chamber 11 to the bottom of the pump. Slits 19 are cut into annular section 15 to provide a nozzle throat separating working vapor region 16 and nozzle element 17. Another annular tubular section 21 is concentrically fitted around chamber 11 and comes into contact with a lower flange of section 15, thereby creating a second divergent nozzle element 25. Slits 27 are cut into annular section 21 to provide a nozzle throat separating working vapor region 16 and nozzle element 25. Yet another annular section 23 is also concentrically positioned around chamber 11 and fits within a lower flange of section 21 to provide a third divergent nozzle element 51. Slits 52 are cut into annular section 23 to provide a nozzle throat separating working vapor region 16 and nozzle element 51. A vapor ejector stage nozzle 35, shown as an open tubular element attached to annular section 23, may also be incorporated.

A working fluid such as polyphenyl ether or silicone is deposited in a reservoir, or boiler 29 at the base of the pump around chamber 11. A heater 31 which may be, e.g. an electrical ring element heater, is positioned at the base of the device and operates to heat the working fluid. The pump is sealed with a top 33 sealed to outer wall 39 with a vacuum seal 34, e.g., by a simple elastomer O-ring. Clearly, access to the vacuum chamber may also be provided through the pump bottom by incorporating a vacuum seal therein.

In operation the working fluid is vaporized by heater 31 creating a vapor pressure within working vapor region 16. The working vapors exit through slit 19 into nozzle element 17 and are ejected from nozzle element 17 a supersonic velocities as is known in the art. Gas molecules to be evacuated from the interior of chamber 11 drift up through the top of that chamber and down into the working vapor stream in the region of nozzle element 17. The region below nozzle element 17 and between annular sections 15, 21, 23 and outside wall 39 and extending generally downward toward the bottom of the pump will be referred to as the "vapor pumping region 14." Momentum transfer from the dense working vapor to the gas molecules provides the "pumping" action and prevents the gas molecules from escaping back into the relatively higher vacuum region above nozzle element 17. The gas molecules are thereby pumped into the region of nozzle element 25, there to encounter a second supersonic stream of working vapor emergent from nozzle element 25. The gas molecules are further compressed by this stream and pumped into the region of nozzle element 51 there to encounter a third supersonic stream of working vapor emergent from nozzle element 51. The gas molecules are further compressed by this stream and pumped into the region of the vapor stream emerging from ejector nozzle 35. This stream sweeps the gas molecules to be evacuated out of the pump into a "fore arm" 37. In most practical embodiments, fore arm 37 leads to a "fore pump" or "rough pump" which initially evacuates the entire system down to a basic working pressure of about $10^{-2}$mm Hg and provides a suitable pressure drop with respect to the working vapor pressure in working vapor region 16 to enable the formation of the vapor stream jets. The diffusion pump mechanism evacuates the system down to pressures of the order of $10^{-7}$mm Hg.

Any number of nozzle stages can be used depending on the level of vacuum required; three stages plus an ejector stage are shown for the purpose of illustration.

To provide a return mechanism for the working fluid, the outer pump wall 39 and fore arm 37 are maintained at a relatively low temperature, for example, by water cooling coils 41 spaced around the walls. When the working vapors come into contact with the interior of the cooled walls, the vapors are condensed and flow downward along the wall and back in to the fluid reservoir 29. The liquid is there vaporized and the cycle is repeated.

Fractionating or self-purifying elements, which are well known in the art as means for improving ultimate vacuum performance and reducing backstreaming when organic working fluids are employed, may also be incorporated in the preferred embodiments. These may be added in the form of essentially concentric cylindrical dividers 24, shown dotted in FIG. 1, located within the working vapor region 16 above the boiler and extending from the boiler to the nozzle elements for the purpose of dividing the working vapor supply to the nozzles, thereby hindering the evolution of the more volatile working fluid fractions into the first stages where they would be more likely to back-diffuse or backstream into the high vacuum regions.

A degree of vapor baffling is obtained in pumps constructed according to the preferred embodiments due to the inherent opacity of the vacuum chamber to backstreaming vapors emanating from the vapor pumping region. By this is meant that a working vapor molecule cannot leave the vapor pumping region and follow a straight-line trajectory into the vacuum chamber; rather it will preferably strike a relatively cool condensing surface.

In preferred embodiments of the device, additional baffling is obtained by including baffle element 43. Baffle 43 includes a flange 45 positioned over nozzle element 17, and thermally insulated from vacuum chamber 11 by insulator 50, to function as a cold cap. Thermal conduction springs 47 maintain thermal contact between the baffle and the cooled outer wall of the pump so that flange 45 is maintained at a cool temperature relative to that of the vapor stream emerging from nozzle element 17. This helps to prevent the expanding working vapors emerging in this region from spreading unnecessarily upward toward the high vacuum regions of the pump. An outer ring 49 may also be included which, in conjunction with the upper portions of baffle 43, forms a relatively low temperature optically-opaque baffle which further reduces the backstreaming of working vapors and thereby prevents contamination of the vacuum regions.

In vacuum pumps configured according to embodiments of the present invention, a single heater may advantageously be used to heat both the working fluid and the vacuum chamber. Typical boiler temperatures for vapor diffusion pumps are in the range of 190° to 270° C, depending upon the particular working fluid utilized. This temperature equilibrates in boiler 29 and working vapor region 16 so that the continuous flux of the hot vapor phase of the working fluid against the wall of the vacuum chamber 11, in combination with heat transfer from boiler 29 itself, induces heating of the vacuum chamber. The temperature of vacuum chamber 11, and hence of any equipment contained therein, will therefore tend toward the boiler temperature. With such a single heater arrangement, the vacuum chamber is heated when the pump is operating and the chamber is cool when the pump is off. This arrangement prevents the occurrence of a situation in which backstreaming vapor from a hot diffusion pump condenses on the unheated interior of the vacuum chamber or onto its contents. Neither can a situation occur in which gases thermally desorb from a hot vacuum chamber or its contents but cannot be pumped away by a non-operating pump. Another advantage of the present invention is that with the exception of the boiler heater there are no high temperature zones exposed to the user or to the outside environment generally. Thus, bulky and expensive insulation is not required, while energy losses are kept to a minimum and less power is required to operate the device.

The present invention has particular applicability in conjunction with chemical analyses performed by a gas chromatograph/mass spectrometer (CG/MS) system. A major problem in the use of a combined GC/MS system is that the operating pressures required by the two techniques differ by about eight orders of magnitude. Thus, if a sample in the effluent of a gas chromatograph is to be mass analyzed in a mass spectrometer, the interface between the two devices must maintain the required pressure differential while yet conveying a usable fraction of the sample to the mass spectrometer. One solution known in the prior art which allows relatively full utilization of GC effluent for mass analysis exploits the fact that the acceptable operating pressure for the ion source in a mass spectrometer may typically be several orders of magnitude higher than the pressure required in the mass analyzer section of the spectrometer. Thus, two separate and relatively small high-vacuum pumps of roughly comparable pumping speed may be utilized, one to maintain the ion source chamber at a reasonably low pressure while handling most of the throughput from the gas chromatograph, and the other maintaining the mass analyzer chamber at a much lower pressure due to much less throughput. In the prior art this has typically required two separate diffusion pumps, each individually powered and cooled and interconnected with separately heated and insulated vacuum chambers enclosing the appropriate mass spectrometer components.

Figure 2:
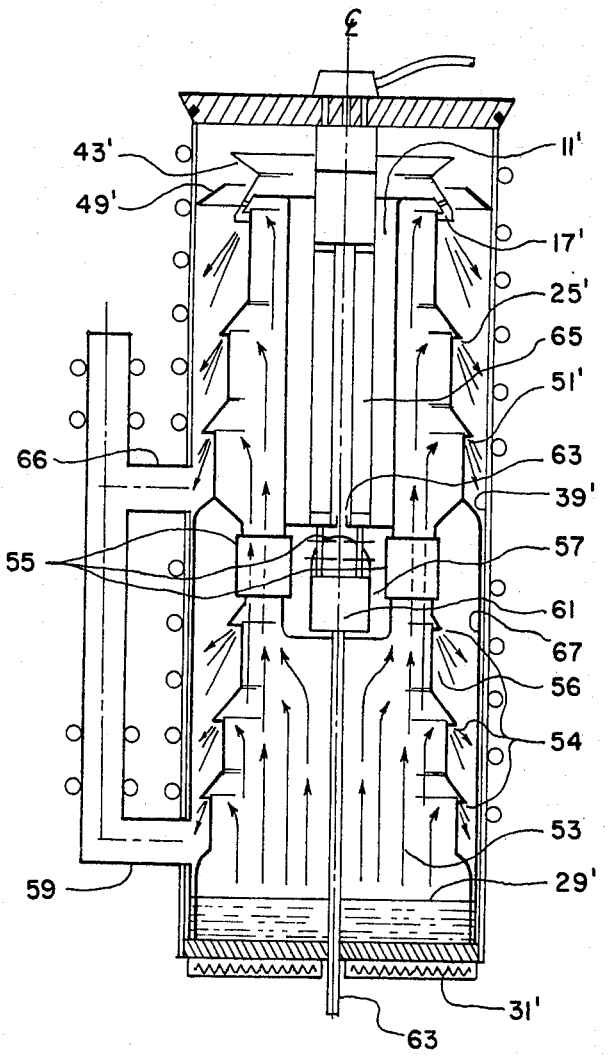
FIG. 2 shows a preferred embodiment of a differential pumping system.

In the embodiment of the present invention schematically illustrated in FIG. 2, the differential pumping of two interconnected vacuum chambers is achieved by a single diffusion pump. The pump consists of two vapor diffusion pump sections, each essentially as described in connection with FIG. 1. These are arranged one above the other in a coaxial configuration having a common boiler which provides the working vapor for both sections and heats the internal vacuum chambers essentially as described in connection with FIG. 1. In the following description, "primed" identifying numerals which correspond to those used in connection with FIG. 1, represent corresponding elements in FIG. 2. Coming now to a more detailed description, a heating element 31′ heats and vaporizes the working fluid as indicated by a number of vertical arrows 53. The vapors rise and emerge at supersonic velocities from a number of nozzles collectively labeled 54, in the manner described above in connection with the FIG. 1. A number of horizontal tubular ports 55 connect the lower vapor pumping region 56 with a lower vacuum chamber 57. Thus, gases to be pumped from lower vacuum chamber 57 drift through ports 55 and are compressed and swept out into a fore arm 59 by the action of the working vapor jets. A low-conductance aperture 63 connects lower vacuum chamber 57 with upper vacuum chamber 11′.

For GC/MS applications, a mass spectrometer ion source 61 may be positioned in lower chamber 57, while he associated mass analyzer 65 may be housed in upper chamber 11′. GC effluent may enter the ion source through a tube 64. Mean free path considerations for a typical ion source require that the pressure in the ion source vacuum chamber, in this case chamber 57, not exceed approximately $10^{-3}$mm Hg. This pressure is maintained by the lower pumping section of the diffusion pump. However, in order to operate a typical mass analyzer 65, mean free path considerations dictate a much lower pressure in the analyzer vacuum chamber, in this case chamber 11′, e.g., a pressure on the order of $10^{-5}$mm Hg. This is accomplished by evacuating upper chamber 11′ with an upper pumping section including nozzle elements 17′, 25′, and 51′. Pumping of gas molecules drifting from chamber 11′ around baffle 43′ is accomplished substantially as described above in connection with FIG. 1. Under these conditions, a pump of the configuration illustrated having an outside diameter of approximately 15cm, and an appropriately sized aperture separating vacuum chambers 11′ and 57, could receive GC effluent at a rate on the order of 5 to 10cm$^3$ atm/minute. Working vapor for the upper pump section is obtained from the same reservoir 29′ which supplies vapor to the lower pump section. More particularly, some vapors 53 from the lower working vapor region pass around ports 55 into the upper working vapor region to be ejected through nozzle elements 17′, 25′, and 51′. Gases pumped out of upper chamber 11′ are ultimately ejected through fore arm 66, which may share a common exit passage with fore arm 59 associated with the lower pumping section. According to this embodiment, then, only a single heater 31′ and a single reservoir 29′ are required to supply both pumping sections with working vapor. Since only a small fraction of effluent gas passes through aperture 63 into upper chamber 11′, the upper pumping section can maintain pressures relatively low compared to those of lower chamber 57.

In this embodiment of the device, the working vapors ejected from nozzles 17′, 25′, and 51′ are condensed on the inner surface of the cooled pumped wall 39′ and flow down along the pump wall back into the lower region and thence into boiler 29′. In the vicinity of the lower pumping section, this returning fluid provides a heat-conducting path between an inner wall 67 and the outer wall 39′, and thereby provides cooling for condensation of the working vapors in the lower section. These latter working vapors therefore condense on inner wall 67, and return to reservoir 29′.

I claim:

1. A vapor diffusion pump comprising:
a housing;
a reservoir of working fluid in said housing;
means forming a chamber in said housing, said chamber being partially immersed in said reservoir to provide thermal contact between said chamber and said working fluid;
a working vapor region substantially concentric with, surrounding, and in thermal communication with said chamber;
at least one vapor pumping region substantially concentric with and surrounding said working vapor region and separated from said working vapor region by at least one nozzle;
heating means for vaporizing working fluid from said reservoir to generate working vapor in said working vapor region; and
condensation means for condensing said working vapor, said condensation means including means for returning said working fluid to said reservoir.

2. A vapor diffusion pump as in claim 1 wherein said vapor pumping means further comprises:
a plurality of annular elements positioned around said chamber to enclose said working vapor region, at least some of said annular elements including portions forming nozzles through which said working vapor is ejected into said at least one vapor pumping region.

3. A vapor diffusion pump as in claim 2 further including baffle means for preventing working vapor from entering said chamber, said baffle means including an annular flange-like portion extending into said vapor pumping region to serve as a cold-cap.

4. A vapor diffusion pump as in claim 2 including fractionating means for preventing volatile working fluid fractions from entering said chamber, said fractionating means comprising at least one annular element positioned within said working vapor region for dividing the working vapor supply to said nozzles.

5. A vapor diffusion pump as in claim 1 wherein said chamber, said working vapor region and said at least one vapor pumping region are substantially surrounded by said condensation means.

6. A vapor diffusion pump as in claim 1 including fractionating means in said working vapor region for preventing volatile working fluid fractions from entering said at least one chamber.

7. A vapor diffusion pump as in claim 1 including demountable vacuum sealing means for providing access to said at least one chamber within said housing.

8. A vapor diffusion pump comprising:
a housing;
means forming a plurality of chambers within said housing;
a reservoir of working fluid;
a working vapor region substantially concentric with and surrounding said chambers;
a plurality of vapor pumping regions substantially concentric with and surrounding said working vapor region and separated from said working vapor region by a plurality of nozzles, each of said vapor pumping regions being associated with one of said chambers for evacuating said associated chamber;

heating means for vaporizing working fluid from said reservoir to generate working vapor in said working vapor region; and condensation means for condensing said working vapor, said condensation means including means for returning said working fluid to said reservoir.

9. A vapor diffusion pump as in claim 8 wherein each of said plurality of chambers is accessible to each adjacent chamber by means of a connecting aperture therebetween.

10. A vapor diffusion pump as in claim 9 further including baffle means for preventing working vapor from entering said chambers, said ballfe means including an annular flange-like portion extending into said vapor pumping region to serve as a cold-cap.

11. A vapor diffusion pump as in claim 8 including fractionating means for preventing volatile working fluid fractions from entering said chambers, said fractionating means comprising at least one annular element positioned within said working vapor region for dividing the working vapor supply to said nozzles.

12. A vapor diffusion pump as in claim 8 wherein said plurality of chambers, said working vapor region, and said plurality of vapor pumping regions are substantially surrounded by said condensation means.

13. A vapor diffusion pump as in claim 8 wherein:

said working vapor region is in thermal communication with said plurality of chambers; and p1 said plurality of chambers are heated by the transfer of heat from said working vapor.

14. A vapor diffusion pump as in claim 13 wherein each of said plurality of chambers is accessible to each adjacent chamber by means of connecting aperture therebetween.

15. A vapor diffusion pump as in claim 14 further including baffle means for preventing working vapor from entering said chambers, said baffle means including an annular flange-like portion extending into said vapor pumping region to serve as a cold-cap.

16. A vapor diffusion pump as in claim 15 wherein said plurality of chambers, said working vapor region, and said plurality of vapor pumping regions are substantially surrounded by said condensation means.

17. A vapor diffusion pump as in claim 8 wherein:

said reservoir of working fluid is in thermal communication with at least one of said plurality of chambers; and said plurality of chambers are heated by the transfer of heat from said reservoir of working fluid.

18. A vapor diffusion pump as in claim 8 wherein each of said plurality of chambers is accessible to each adjacent chamber by means of connecting aperture therebetween.

19. A vapor diffusion pump as in claim 18 further including baffle means for preventing working vapor from entering said chambers, said baffle means including an annular flange-like portion extending into said vapor pumping region to serve as a cold-cap.

20. A vapor diffusion pump as in claim 19 wherein said plurality of chambers, said working vapor region, and said plurality of vapor pumping regions are substantially surrounded by said condensation means.

21. A vapor diffusion pump as in claim 8 wherein:

said heating means comprises a heater in thermal communication with said reservoir and at least one of said plurality of chambers for vaporizing working fluid from said reservoir to generate working vapor in said working vapor region and for heating said plurality of chambers.

22. A vapor diffusion pump as in claim 21 wherein each of said plurality of chambers is accessible to each adjacent chamber by means of connecting aperture therebetween.

23. A vapor diffusion pump as in claim 22 further including baffle means for preventing working vapor from entering said chambers, said baffle means including an annular flange-like portion extending into said vapor pumping region to serve as a cold-cap.

* * * * *